US007281950B2

(12) United States Patent
Belopolsky

(10) Patent No.: US 7,281,950 B2
(45) Date of Patent: Oct. 16, 2007

(54) HIGH SPEED CONNECTORS THAT MINIMIZE SIGNAL SKEW AND CROSSTALK

(75) Inventor: Yakov Belopolsky, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 36 days.

(21) Appl. No.: 10/953,749

(22) Filed: Sep. 29, 2004

(65) Prior Publication Data

US 2006/0068610 A1 Mar. 30, 2006

(51) Int. Cl.
*H01R 13/648* (2006.01)

(52) U.S. Cl. ..... 439/608; 439/511

(58) Field of Classification Search ..... 439/608, 439/941, 924.1, 510, 507, 509
See application file for complete search history.

(56) References Cited

U.S. PATENT DOCUMENTS

| | | | | | |
|---|---|---|---|---|---|
| 2,849,700 | A * | 8/1958 | Perkin | 439/720 |
| 2,858,372 | A * | 10/1958 | Kaufman | 379/325 |
| 3,343,120 | A * | 9/1967 | Whiting | 439/510 |
| 3,591,834 | A * | 7/1971 | Kolias | 361/791 |
| 3,641,475 | A | 2/1972 | Irish et al. | 339/17 L |
| 3,701,076 | A | 10/1972 | Irish | 339/17 |
| 4,523,296 | A * | 6/1985 | Healy, Jr. | 439/651 |
| 4,997,390 | A * | 3/1991 | Scholz et al. | 439/509 |
| 5,169,337 | A * | 12/1992 | Ortega et al. | 439/510 |
| 5,522,727 | A * | 6/1996 | Saito et al. | 439/65 |
| 5,938,479 | A | 8/1999 | Paulson et al. | 439/676 |
| 6,042,427 | A | 3/2000 | Adriaenssens et al. | 439/676 |
| 6,526,519 | B1 * | 2/2003 | Cuthbert | 713/503 |
| 6,540,558 | B1 * | 4/2003 | Paagman | 439/608 |
| 6,633,490 | B2 * | 10/2003 | Centola et al. | 361/785 |

* cited by examiner

*Primary Examiner*—Neil Abrams
*Assistant Examiner*—Phuongchi Nguyen
(74) *Attorney, Agent, or Firm*—Woodcock Washburn LLP

(57) ABSTRACT

The invention is an electrical connector that minimizes signal skew caused by varying propagation times through different transmission paths within the connector, minimizes crosstalk caused by intermingling electric fields between signal contacts, and maximizes signal density within the connector. The electrical connector may include a plug and receptacle housing, plug contacts, receptacle contacts, and contact plates. The contact plates may include connecting contacts that electrically connect plug contacts to receptacle contacts. The electrical connector minimizes signal skew by maintaining substantially equal-length transmission paths within the connector through varying the lengths and positions of plug and receptacle contacts. The electrical connector minimizes crosstalk by surrounding the connecting contacts with electrical ground by placing the connecting contacts in grooves of the connecting plates. Placing the contacts in such grooves maximizes the signal density of the contact by enabling the contacts to be placed in close proximity with other contacts while minimizing crosstalk.

48 Claims, 9 Drawing Sheets

HIGH SPEED CONNECTORS THAT MINIMIZE SIGNAL SKEW AND CROSSTALK

FIELD OF THE INVENTION

Generally, the invention relates to electrical connectors. More particularly, the invention relates to electrical connectors that provide high speed, uniform signal propagation, and low interference communications.

BACKGROUND OF THE INVENTION

Electrical connectors provide signal connections between electronic devices using signal contacts. In many applications of electrical connectors, for example electrical connectors associated with printed wiring boards (PWB), the physical characteristics and close proximity of the signal contacts within the electrical connector may cause degradation of signal integrity. Two causes of signal degradation in electrical connectors are commonly referred to as "skew" and "crosstalk."

Degradation of signal integrity may be caused by signal propagation delay in one conductor with regard to a related conducted. Signal propagation delay is commonly referred to as "signal skew" or "skew." One cause of skew in an electrical connector is varying electrical paths within the connector through which signals are conducted. In particular, the electrical path of one conductor will be different than the electrical path of another conductor if the physical length of the conductors in the respective paths are not equal. For example, in differential signal transmission where one signal is carried over two conductors, if the first electrical path for the signal is through a conductor that is physically longer than a conductor used in the second electrical path, the propagation time for each signal through the paths may not be equal. The unequal signal propagation time causes signal skew and degrades signal integrity.

Skew is a particular concern when connecting co-planar devices such as printed wiring boards or printed circuit boards. Often, two right-angle connectors are used when connecting co-planar devices. Each right angle connector may inherently create skew, and therefore, the use of two such connectors in combination intensifies the skew, creating significant degradation of signal integrity. FIG. 1 shows skew associated with prior art, co-planar connectors. FIG. 1 is a side cross section view of prior art, right-angle connectors 173, 174 used to connect two substantially co-planar devices 171, 172. FIG. 1 shows two transmission paths 175, 176 through connectors 173, 174 from device 171 to device 172. In right angle-connector 173, transmission path 175 is longer than transmission path 176, creating signal skew. Likewise, right angle connector 174 suffers from signal skew as well because transmission path 175 is also longer than transmission path 176. Connecting devices 171, 172 using right angle connectors 173, 174 increases the skew that would be present if the devices were connected in a perpendicular manner using just one of the right angle connectors 173, 174.

Another cause of signal degradation is commonly called "crosstalk." Crosstalk occurs when one signal contact induces electrical interference in another signal contact that is in proximity to it. The electrical interference is caused by intermingling electrical fields between the two contacts. Such interference is a particular problem when signal contacts are closely spaced in electrical connectors. Like skew, crosstalk also may cause significant degradation of signal integrity.

Solutions to the problems of signal skew and crosstalk in an electrical connector are generally in tension. It is well-known in the art of electrical connectors that one way of minimizing skew is to decrease the physical spacing between signal contacts. Decreasing the spacing minimizes skew because the differences in the electrical path—and therefore signal propagation time—are minimized. Decreasing spacing is a welcome solution to skew because, by decreasing spacing, the signal contact density—that is, the number of signal contacts per unit area—of the connector increases.

Minimizing skew by decreasing contact spacing, however, may create or further intensify crosstalk. Crosstalk, as explained, is caused by intermingling electric fields, and therefore placing signal contacts closer together intensifies the intermingling. The solution to the problem of crosstalk is generally to place signal contacts further apart and if possible, to place ground contacts between signal contacts. The solution to crosstalk, therefore, may create or intensify skew and decrease the signal density of the electrical connector.

With electronic device miniaturization and the omnipresent and accelerating need for high speed electronic communications, the reduction of skew and crosstalk are significant goals in electrical connector design. Therefore, there is a need for an electrical connector that minimizes skew and crosstalk while maximizing the signal density of the connector.

SUMMARY OF THE INVENTION

An electrical connector is disclosed, comprising, in one embodiment, a first and a second contact with a third contact at an angle to and electrically connecting the first and second contacts, wherein an electrical path through the first, second, and third contacts is a first transmission path, and a fourth and a fifth contact with a sixth contact at an angle to and electrically connecting the fourth and fifth contacts, wherein the electrical path through the fourth, fifth, and sixth contacts is a second transmission path, and wherein the first and second transmission paths have a relatively similar signal propagation time. Contacts may be placed in grooves carved out of a metal core associated with electrical ground to minimize intermingling electrical fields between conductors and thus minimize cross talk and maximize signal density of the connector.

In an alternative embodiment, the electrical connector may comprise a first transmission path electrically connecting a first device to a second device, wherein the second device is substantially co-planar with the first device and a second transmission path electrically connecting the first device to the second device, wherein the first and second transmission paths have relatively similar signal propagation times.

In another embodiment, the electrical connector may comprise a plug housing having a plurality of plug contacts, a receptacle housing having a plurality of receptacle contacts, wherein the receptacle contacts are substantially parallel to the plug contacts, a plurality of connecting contacts, wherein each connecting contact electrically connects a plug contact to a receptacle contact to form a transmission path, and wherein each transmission path has a relatively similar signal propagation time as each of the other transmission paths.

DETAILED DESCRIPTION OF ILLUSTRATIVE EMBODIMENTS

Figure 1:
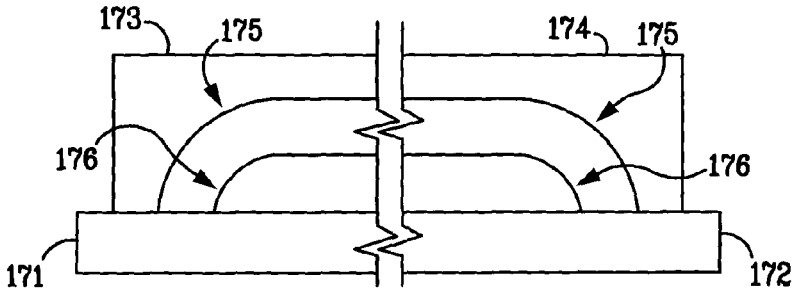
FIG. 1 is a side cross section view of a prior art method for connecting two substantially co-planar devices.
Figure 2A:
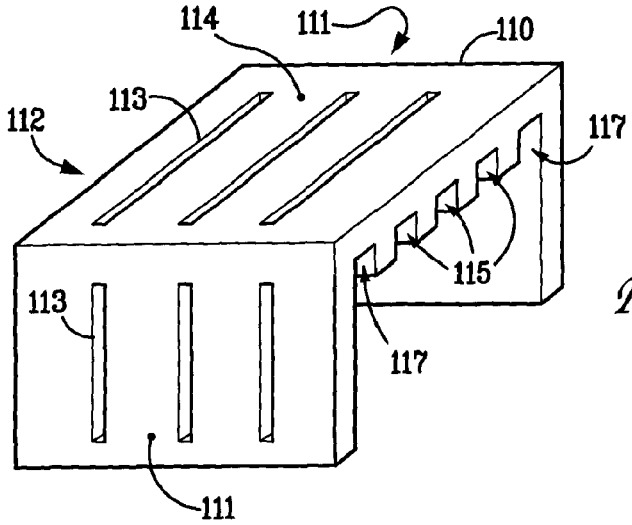
FIG. 2A is an exploded top perspective view of a plug housing.

FIG. 2A depicts an example embodiment of a plug housing 110. Plug housing 110 includes side walls 111, a rear wall 112, and a ceiling 114. Plug housing 110 may contain contact plate slots 115 adapted to receive contact plates (not shown). Plug housing 110 may also comprise receptacle housing slots 117 for receiving and facilitating connection with a receptacle housing by allowing the sides of the receptacle housing to slide into the receptacle housing slots 117 of plug housing 110. Plug housing 110 also may include air slits 113 on ceiling 114 or side walls 111 to facilitate thermal release and improve the thermal properties of the electrical connector. Plug housing 110 is shown to be configured to receive three contact plates (not shown) in slots 115 and to receive the receptacle housing sides in receptacle housing slots 117. Plug housing 110, however, may be adapted to receive any number of contact plates. Additionally, a receptacle housing (not shown) may be connected to plug housing 110 with the use of receptacle housing slots 117 or by any other suitable means. Plug housing 110 may be constructed of plastic.

Figure 2B:
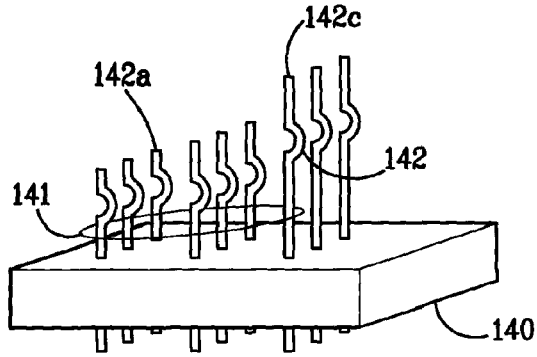
FIG. 2B is an exploded top perspective view of a contact base.

FIG. 2B depicts an example embodiment of a contact base 140 for plug housing 110 and for a receptacle housing (not shown). Contact base 140 may include a plurality of contact rows 141 each comprising a plurality of contacts 142. The contacts 142 in each contact row 141 may be of differing lengths and therefore be disposed to electrically connect with connecting contacts on a contact plate (not shown), discussed below. As shown in FIG. 2E, contact base 140 may also include contact plate guiding slots 145, which may facilitate guiding and supporting contact plates 120 in plug housing 110 or receptacle 130. In one embodiment, the shortest contacts 142*a* may be located near the rear of contact plate 140 (and therefore near rear wall 112 of plug housing 110 when contact plate 140 is attached to plug housing 110). The longer contacts 141*c* may be located toward the front of contact plate 140 and therefore toward the front of plug housing 110 when contact base 140 is attached to plug housing 110.

Contacts 142 may protrude through contact base 140 for support and to connect with a device such as a printed wiring board (PWB) or printed circuit board (PCB). Contact base 140 and contacts 142 may be configured to be press-fit into such a device. Contacts 142 are shown to be substantially perpendicular with contact base 140. It should be appreciated, however, that contacts 142 may be at any angle to contact base 140. A contact base 140 may attach to plug housing 110 and a separate contact base 140 may attach to a receptacle housing (not shown) by any suitable means. Contact base 140 may be constructed of plastic or of the same material as the plug housing and be of any suitable thickness.

Figure 2C:
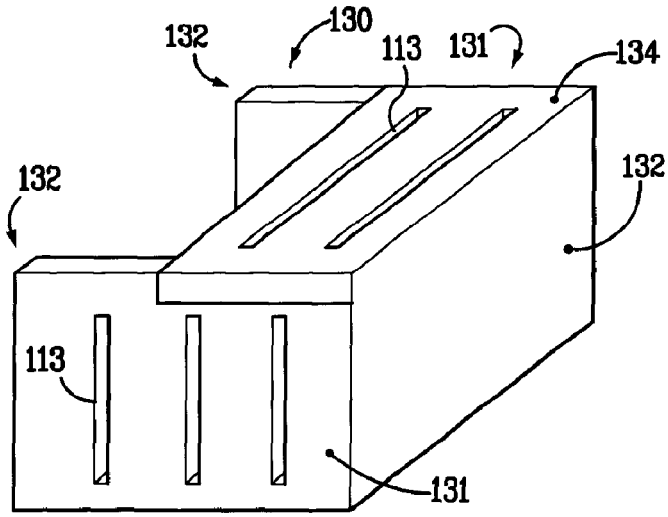
FIG. 2C is an exploded top perspective view of a receptacle housing.

FIG. 2C depicts an example embodiment of a receptacle housing 130. Receptacle housing 130 includes side walls 131, a rear wall 132, and a ceiling 134. Receptacle housing side walls 131 may extend beyond receptacle housing ceiling 134 and be disposed to slide into receptacle housing slots 117 (FIG. 2A) of plug housing 110 (FIG. 2A). Receptacle housing 130 may contain contact plate slots (FIG. 2E) similar to plug housing contact plate slots 115 (FIG. 2A) adapted to receive contact plates 120. Receptacle housing 130 also may include air slits 113 on ceiling 134 or on sides 131 to facilitate thermal release and improve the thermal properties of the electrical connector. Receptacle housing 130 may be constructed of plastic.

As described above, contact base 140 (FIG. 2B) may attach to plug housing 110 (FIG. 2A). A separate contact base 140 may attach to receptacle housing 130 by any suitable means as well. The length of contacts 142 (FIG. 2B) on contact plate 140 attached to receptacle housing 130 would correspond with contacts 142 on contact plate 140 attached to plug housing 110 (FIG. 2A). That is, shorter contacts 142*a* may be located toward rear wall 112 of plug housing 110 and also toward rear wall 132 of receptacle housing 130. Longer contacts 142*c* would be located toward the front of plug housing 110 and toward the front of receptacle housing 130.

Figure 2D:
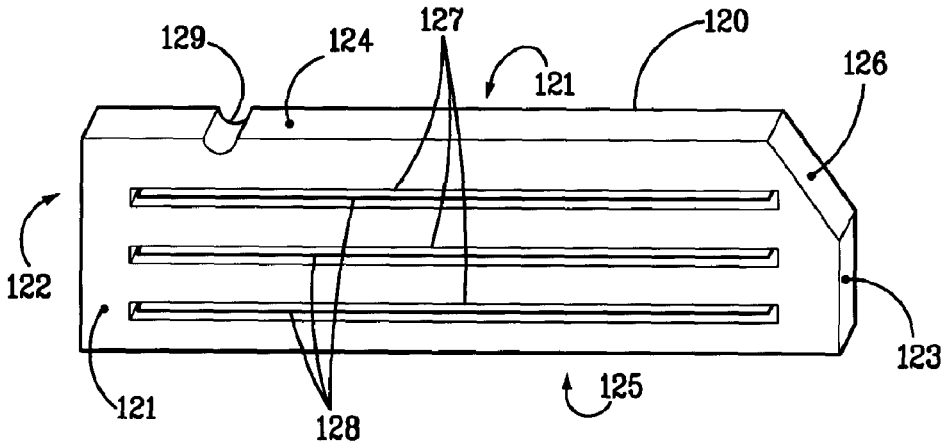
FIG. 2D is an exploded top perspective view of and a contact plate.
Figure 2E:
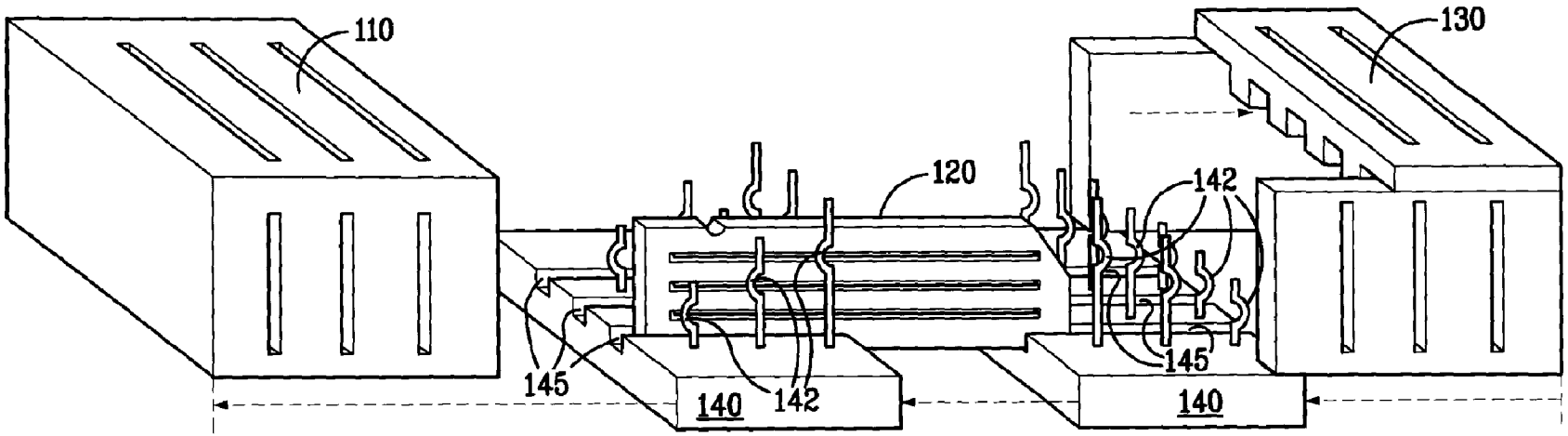
FIGS. 2E and 2F are exploded perspective views of an example electrical connector assembly according to one embodiment of the invention.

FIG. 2D depicts an example embodiment of a contact plate 120. Contact plate 120 has sides 121, a back 122, a front 123, a top 124 and a bottom 125. The widths of top 124, bottom 125, back 122 and front 123 are substantially uniform and such that contact plate 120 may slide into contact plate slots 115 (FIG. 2A) of plug housing 110 (FIG. 2A) and corresponding slots (not shown) in receptacle housing 130. Contact plate 120 may include grooves 127 along the length of sides 121. As described below in further detail with regard to FIG. 6, grooves 127 may contain connecting contacts 128. Connecting contacts 128 are signal contacts disposed to electrically connect with contacts 142 (FIG. 2B) on contact base 140 when contact base 140 and contact plate 120 are installed in plug housing 110 (FIG. 2A) and receptacle housing 130. Connecting contacts 128 are shown to be parallel with the length of contact plate 120. It should be appreciated, however, that connecting contacts may be in virtually any orientation to electrically connect contacts 142 in plug housing 110 (FIG. 2A) with contacts 142 in receptacle housing 130. Contact plate 120 may also include a retaining dimple 129 that facilitates securing contact plate 120 in plug housing 110 or receptacle housing 130 through mechanical interlock with a beam within the applicable housing (not shown).

In one embodiment, contact plates 120 are fixed in plug housing 110 (FIG. 2A). Receptacle housing 130 is slidably disposed to plug housing 110 and to contact plates 120. Additionally, contact plate 120 may include an angled portion 126 on front 123 to facilitate mating of contact plate 120 with receptacle housing 130. Contact plate 120, however, may be fixed in receptacle housing 130, and plug housing 110 may be slidably disposed to receptacle housing 130 and contact plates 120. Alternatively, as shown in FIG. 2E, contact plates 120 may be slidably disposed towards and remain unfixed in both plug housing 110 (FIG. 2A) and receptacle housing 130.

Figure 2F:
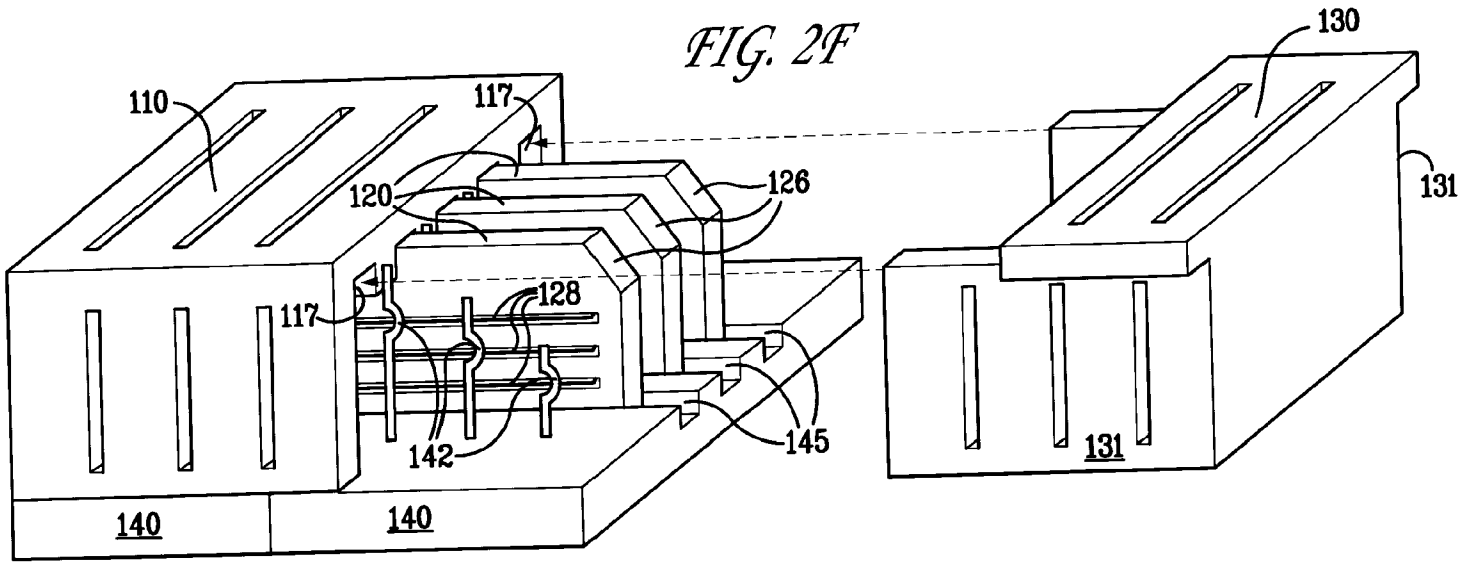
Figure 2G:
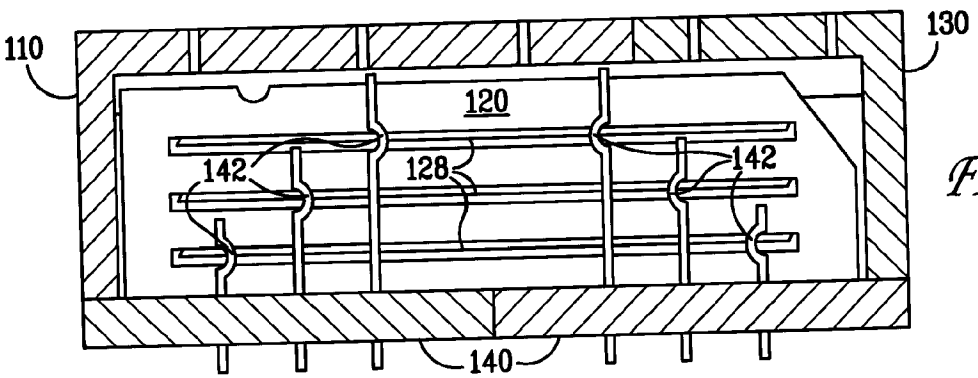
FIG. 2G is a side cross-section view of an example electrical connector assembly according to one embodiment of the invention.

In one embodiment, contact base 140 (FIG. 2B) may be attached to plug housing 110 (FIG. 2A) and a separate contact base 140 (FIG. 2B) may be attached to receptacle housing 130. As shown in FIG. 2F, contact plates 120 may be inserted into contact plate slots 115 of plug housing 110 (FIG. 2A) and fixed within plug housing 110 (FIG. 2A) through operation of a retaining bar (not shown) engaging retaining dimple 129 of contact plates 120. As shown in FIGS. 2F and 2G, receptacle housing 130 and contact plate 140 (FIG. 2B) may then be connected to plug housing 110 (FIG. 2A) by sliding receptacle housing sides 131 into receptacle housing slots 117 of plug housing 110 until contacts 142 on contact base 140 of receptacle housing 130 contact with the corresponding connecting contacts 128 on contact plate 120. The connector could then be, for example, press-fit onto or otherwise connected to a device such as a PWB or PCB.

Figure 3:
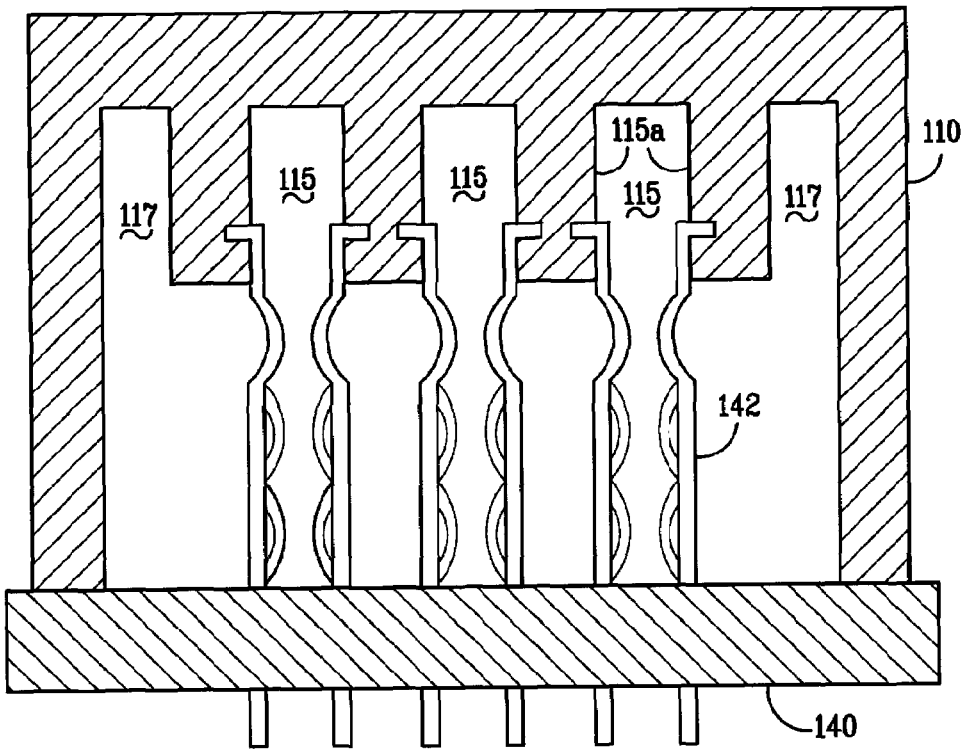
FIG. 3 is a front cross section view of the plug housing and contact base shown in FIGS. 2A-2B.

FIG. 3 is a front, sectional view of an example embodiment of plug housing 110 with contact plate 140 attached in accordance with the invention. Plug housing 110 may include contact plate slots 115 and receptacle housing slots 117. Contacts 142 may protrude through contact plate 140 for support and to facilitate connection to a device. In one embodiment, contacts 142 may be supported by sides 115*a* of contact plate slots 115. This support is shown in greater detail in FIG. 4.

Figure 4A:
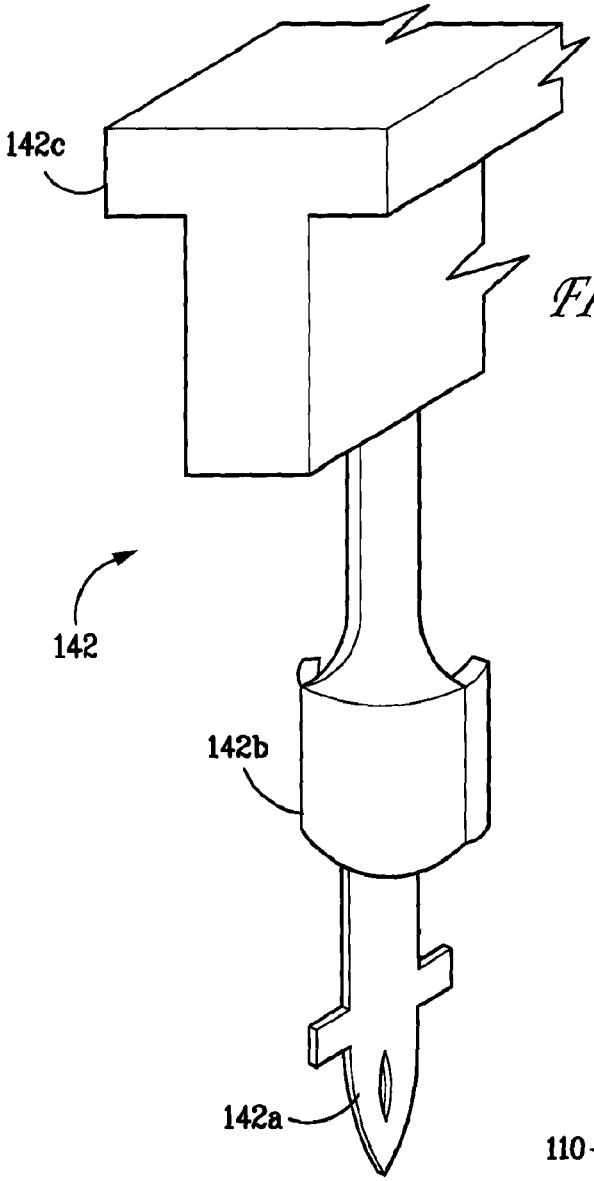
FIG. 4A is an exploded top perspective view of a contact.

FIG. 4A depicts an example embodiment of contact 142 in accordance with the invention. Contact 142 may have a tip 142*a* protruding through contact base 140 (not shown) and electrically connecting with a device. Contact 142 may also have a contact surface 142*b* for facilitating contact with connecting contact 128 (FIG. 2D) on contact plate 120 (FIG. 2D). At the end opposite tip 142*a*, the contact may be formed as part of an overmolded wafer 142*c*. Overmolded wafer 142*c* may be constructed of plastic or of the same material as plug or receptacle housings 110, 130.

Figure 4B:
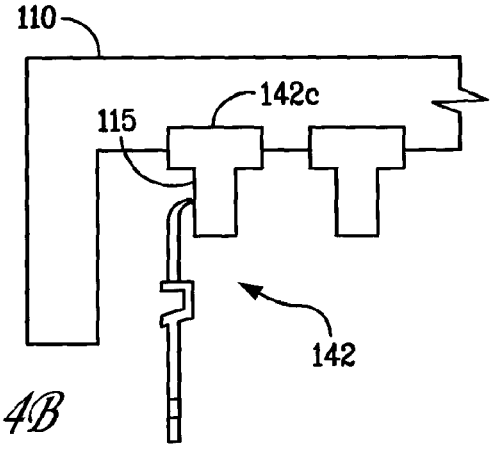
FIG. 4B is a front, partial cutaway view of a cross section of a plug housing containing the contact shown in FIG. 4A.

FIG. 4B is a cut-away view of a front, cross section of an example embodiment of plug housing 110 or receptacle housing 130 in accordance with the invention. FIG. 4B shows an overmolded wafer 142*c* with contact 142 formed as part of it. Overmolded wafer 142*c* may be attached or formed as part of plug housing 110 or receptacle housing 130. More specifically, overmolded wafer 142*c* may be formed as part of contact plate slot 115 of plug housing 110 or of a corresponding slot in receptacle housing 130.

Figure 5:
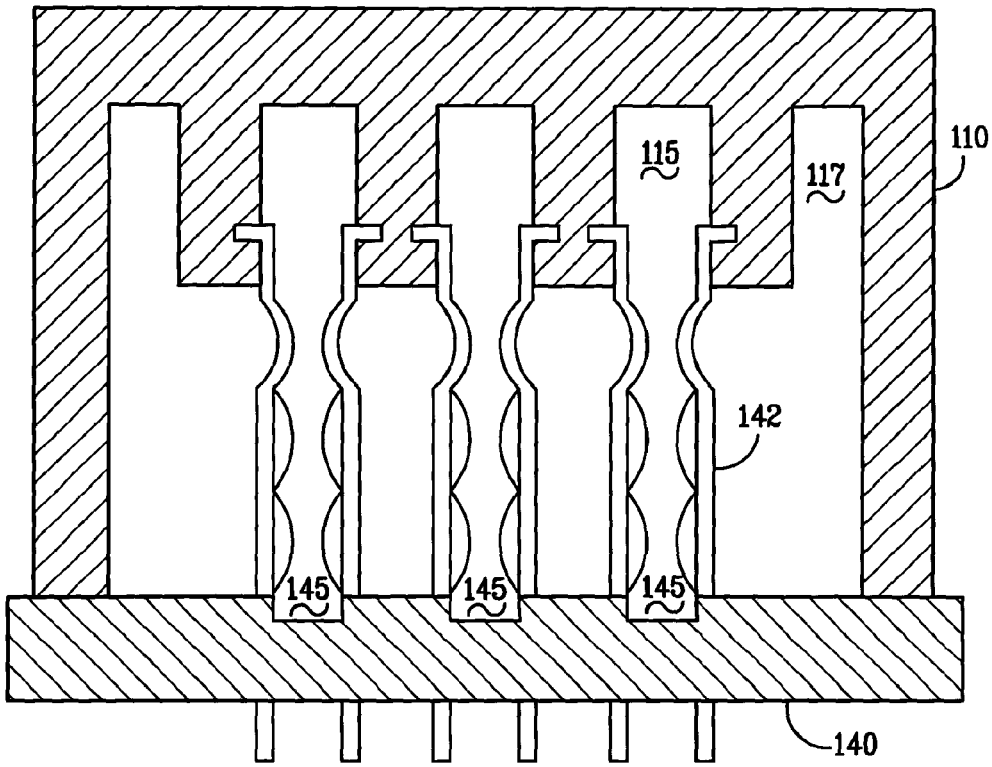
FIG. 5 is a front cross section view of an alternative embodiment of a plug housing with a contact base that includes contact plate guiding slots.

FIG. 5 is a front, sectional view of an alternative example embodiment of a plug housing 110 and contact plate 140. FIG. 5 is described in relation to plug housing 110 but the elements of FIG. 5 may be present in receptacle housing 130 as well. Plug housing 110 and contact plate 140 include the elements as shown and described with regard to plug housing 110 and contact plate 140 of FIG. 3 and therefore such elements are not further described with regard to FIG. 5. In addition, contact base 140 may include contact plate guiding slots 145. Contact plate guiding slots 145 may facilitate guiding and supporting contact plates 120 (not shown) in plug housing 110 or receptacle housing 130 (FIG. 2D).

It should be noted that, while FIGS. 3-5 describe example embodiments with regard to plug housing 110, the descriptions may be equally applicable to receptacle housing 130 (FIG. 2C). Consistent with the invention, receptacle housing 130 may have slots for receiving plug housing sides 111 (FIG. 2A) if configured similar to receptacle housing sides 131 (FIG. 2C) of housing receptacle 130 (FIG. 2C).

Figure 6:
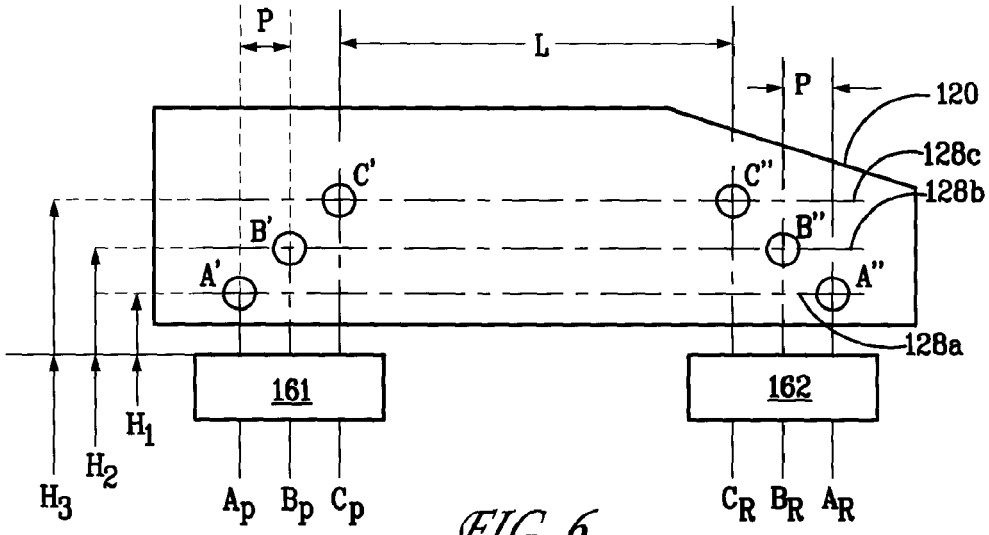
FIG. 6 is a side cross section view of a contact plate.

FIG. 6 illustrates maintaining substantially equal transmission paths through the electrical connector, thereby minimizing skew. FIG. 6 depicts a side view of a cross section of an example embodiment of contact plate 120 in accordance with the invention. More specifically, FIG. 6 shows the relative location of contact plate 120 when the electrical connector is connecting two substantially co-planar devices 161, 162. Co-planar devices 161, 162 may be PWBs or any other electronic device. It should be noted that the electrical connector also may be used in connecting non-co-planar devices as well. FIG. 6 represents just one of many ways in which the electrical connector may be constructed with transmission paths of substantially equal length in accordance with the invention. FIG. 6 does not show plug housing 110 (FIG. 2A) or receptacle housing 130 (FIG. 2C) for the sake of clarity.

In FIG. 6, contacts $A_P$, $A_R$, $B_P$, $B_R$, $C_P$, and $C_R$ represent contacts 142 (FIG. 2B) on contact plate 140 (FIG. 2B). Points $A^1$, $A^{11}$, $B^1$, $B^{11}$, $C^1$, and $C^{11}$ represent the locations where respective contacts $A_P$, $A_R$, $B_P$, $B_R$, $C_P$, and $C_R$ electrically connect with connecting contacts 128 of contact plate 120 when the electrical connector is assembled. While connecting contacts 128 are shown to be at essentially a right angle to contacts 142, it should be appreciated that connecting contacts 128 may be at any angle to contacts 142. Points $A^1$ and $A^{11}$ are located at a height $H_1$ from, respectively, devices 161, 162. Points $B^1$ and $B^{11}$ are located at a height $H_2$ from, respectively, devices 161, 162. Points $C^1$ and $C^{11}$ are located at a height $H_3$ from, respectively, devices 161, 162. The horizontal spacing between contacts $A_P$ and $B_P$, between $B_P$ and $C_P$, between $A_R$ and $B_R$, and between $B_R$ and $C_R$ is equal to a length p.

Length p is equal to the length $H_1$ of each of contacts $A_P$ and $A_R$. The length $H_2$ of each of contacts $B_P$ and $B_R$ is equal to two times length $H_1$. The length $H_3$ of each of contacts $C_P$ and $C_R$ is equal to three times length $H_1$. The length L between contacts $C_P$ and $C_R$ is equal to the length of connecting contact 128*c* that connects $C_P$ and $C_R$. The following mathematical equations show how, in one example embodiment of the invention, the three transmission path lengths $A_P$, $A_R$, $B_P$, $B_R$, and $C_P$, $C_R$ are equal:

$$A_P,\ A_R=H_1+2p+L+2p+H_1=2H_1+4p+L=2H_1+4H_1+L=6H_1+L$$

$$B_P,\ B_R=H_2+p+L+p+H_2=2H_2+2p+L=2H_2+2H_1+L=4H_1+2H_1+L=6H_1+L$$

$$C_P,\ C_R=H_3+L+H_3=2H_3+L=6H_1+L$$

Therefore, the transmission path from device 161 through contact $A^1$, connecting contact 128*a*, and contact $A^{11}$ to device 162 is equal in length to the transmission path from device 161 through contact $B^1$, connecting contact 128*b*, and contact $B^{11}$ to device 162. Additionally, the transmission path from device 161 through contact $C^1$, connecting contact 122*c*, and contact $C^{11}$ to device 162 is substantially equal to each of the other two transmission paths. Because the transmission paths through the connector are of equal lengths, the electrical connector may be used to connect two substantially co-planar devices 161, 162 while minimizing skew. Of course, in other embodiments of the invention, the above mathematical equations may not be applicable. The relationship between the lengths of and the spacing between contacts 142 may be altered while maintaining equivalent transmission paths. Additionally, in alternative embodiments, the contacts may be straight as depicted in FIG. 6, bent, curved or of any other appropriate shape.

FIG. 7 depicts cross section end views of example embodiments of contact plates 120 (FIG. 2D) in accordance with the invention. FIG. 7 shows various ways to reduce or minimize crosstalk between signal contacts in the electrical connector in accordance with the invention.

Figures 7A, 7B, 7C, 7D:
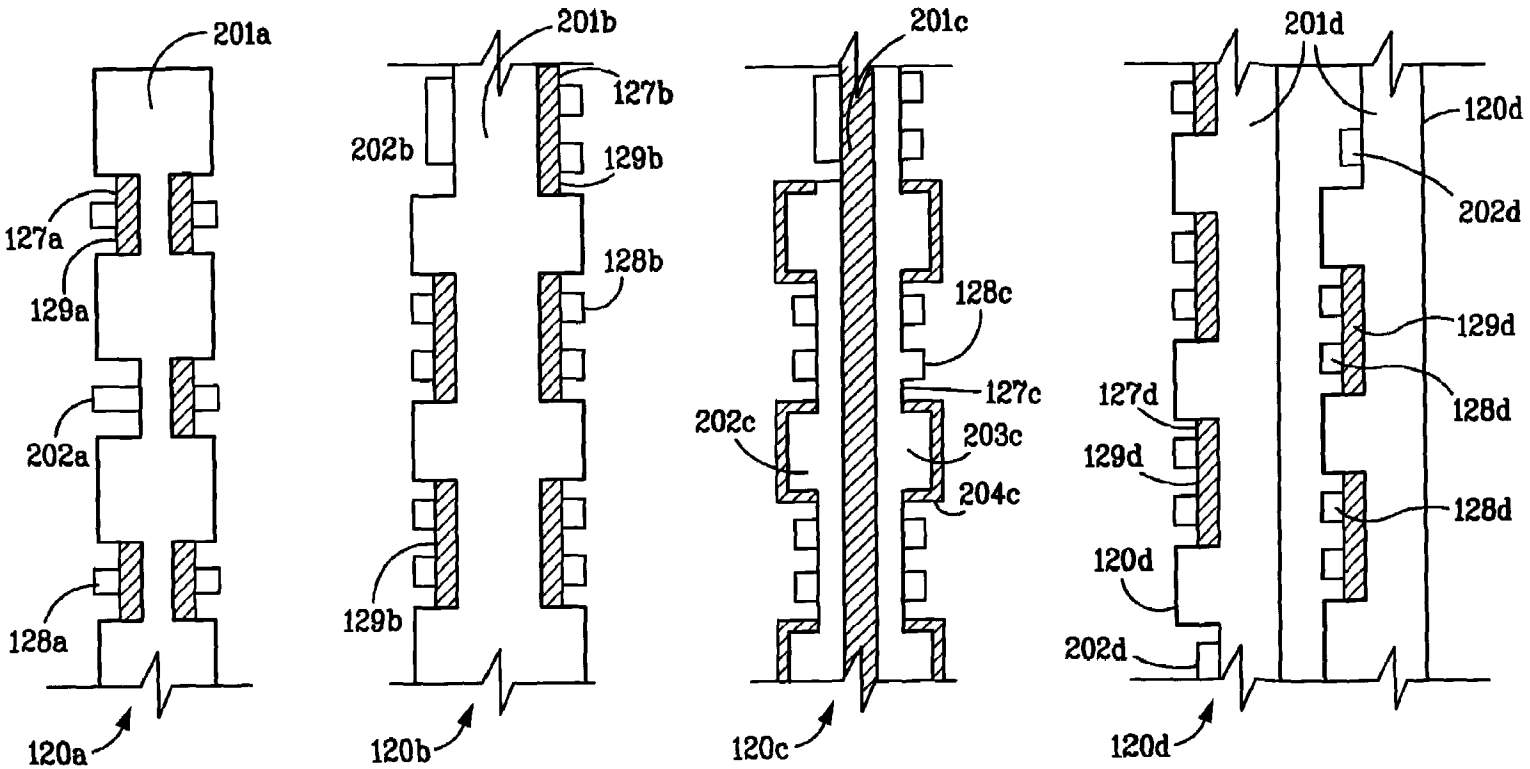
FIG. 7A is a front cross section view of a contact plate for single-end transmission.
FIG. 7B is a front cross section view of a contact plate for differential transmission.
FIGS. 7C-7E are front cross section views of alternative embodiments of a contact plate.

FIG. 7A depicts an embodiment of a contact plate 120*a* to be used to minimize crosstalk in accordance with the invention. Contact plate 120*a* may include a metal core 201*a* that serves as an electrical ground. The metal core may contain grooves 127*a* that are covered by a dielectric material 129*a*, such as oxide or polyimide film. Connecting contacts 128*a* may be affixed to dielectric layer 129*a*. Additionally, contact plate 120*a* may have a ground contact 202*a* affixed to the core 201*a* if deemed necessary. When affixed to dielectric layer 129*a* in grooves 127*a*, connecting contacts 128*a* are surrounded by electrical ground of metal core 201*a*. Surrounding connecting contacts 128*a* with ground minimizes cross talk in the connector by preventing electric fields that surround connecting contacts 128*a* from intermingling. Contact plate 120*a* may be used in connectors using single-ended transmission.

FIG. 7B depicts an example embodiment of contact plate 120*b* that may be used in an electrical connector. Contact plate 120*b* is similar to contact plate 120*a* (FIG. 7A) except that contact plate 120*b* may be used for differential transmission of signals through the electrical connector. Like contact 120*a* (FIG. 7A), contact 120*b* may include a metal core 201*b*, grooves 127*b* that are covered by a dielectric material 129*b*, and ground contacts 202*b* attached to metal core 201*b*. Unlike contact plate 120*a*, however, contact plate 120*b* includes two connecting contacts 128*b* in each groove 127*b*. The two connecting contacts 128*b* in each groove 127*b* carry the transmission signal.

FIG. 7C depicts an alternative embodiment of contact plate 120*c* for use in an electrical connector. Contact plate 120*c* has a metal core 201*c* with a dielectric layer 203*c* affixed to metal core 201*c*. Dielectric layer 203*c* may be constructed of plastic. Grooves 127*c* are formed in dielectric layer 203*c* and connecting contacts 128*c* are placed in grooves 127*c* on dielectric layer 203*c*. The areas 204*c* around the connecting contacts may be coated with metal or "metallized." Additionally a ground contact 202*c* may be placed on metal core 201*c*. Contact plate 120*c* as shown may be used in differential transmission in electrical conductors, but those skilled in the art of electrical connectors would recognize that contact plate 120*c* could be adapted for use with single-ended transmissions as well.

FIG. 7D is an alternative embodiment of contact plate 120*d* for use in an electrical connector. In FIG. 7D, two contact plates 120*d* are shown. As with contact plate 120*b* (FIG. 7B), contact plates 120*d* may include a metal core 201*d*, grooves 127*d* that are covered by a dielectric material 129*d*, and ground contacts 202*d* attached to metal core 201*d*. Additionally, grooves 127*d* may each have two connecting contacts 128*d* for differential transmission. Contrary to contact plate 120*b*, contact plates 120*d* may have connecting contacts on only one side. Contact plates 120*d* may be closely spaced together in plug housing 110 (FIG. 2A) and receptacle housing 130 (FIG. 2C) so that the metal core 201*d* of one contact plate 120*d* is in close proximity to connecting contacts 128*d* of an adjacent contact plate 120*d*. Similar to placing connecting contacts 128*d* in grooves 127*d* surrounded by metal core 201*d*, maintaining a close proximity between core 201*d* of one contact plate 120*d* and the connecting contacts 128*d* of a second contact plate 120*d* decreases crosstalk between connecting contacts 128*d*.

Figure 7E:
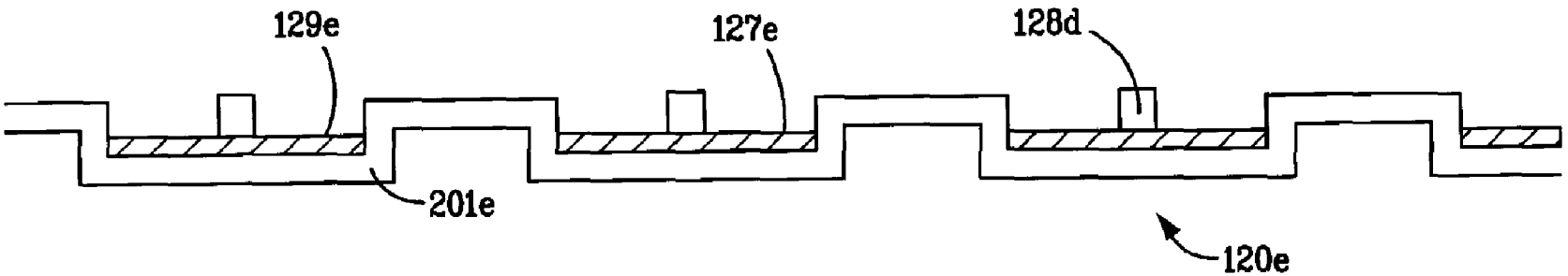

FIG. 7E is an alternative embodiment of contact plates 120*e* for use in an electrical connector. In this embodiment, the metal core may be bent or stamped to create grooves 127*e*, which may be a less expensive way to manufacture contact blades to reduce crosstalk according to the invention.

It is to be understood that even though numerous characteristics and advantages of the present invention have been set forth in the foregoing description, the disclosure is illustrative only and changes may be made in detail within the principles of the invention to the full extent indicated by the broad general meaning of the terms in which appended claims are expressed. For example, the electrical connector has been described in conjunction with connecting two substantially co-planar devices such as PWBs. It should be recognized, however, that the invention may be used in connecting other devices including those that are not co-planar.

What is claimed is:

1. An electrical connector, comprising:

a contact base;

a first contact and a second contact each received in the contact base, wherein the first and second contacts define a first row of electrical contacts in a first direction and extend from the contact base in a second direction, and wherein the first and second contacts are separated from one another in the first direction by a first distance;

a third contact and a fourth contact each received in the contact base, wherein the third and fourth contacts define a second row of electrical contacts in the first direction and extend from the contact base in the second direction, and wherein the third and fourth contacts are separated from one another in the first direction by the first distance;

a fifth contact electrically connecting the first and third contacts, wherein the fifth contact is at an angle to the first and third contacts and makes electrical contact with at least one of the first and third contacts a second distance from the contact base in the second direction, and wherein an electrical path through the first, third, and fifth contacts defines a first transmission path; and a sixth contact electrically connecting the second and fourth contacts, wherein the sixth contact is at an angle to the second and fourth contacts and makes electrical contact with at least one of the second and fourth contacts a third distance from the contact base in the second direction, wherein an electrical path through the second, fourth, and sixth contacts defines a second transmission path, wherein the first distance is equal to the second distance, and wherein the third distance is two times the first distance.

2. The electrical connector of claim 1, wherein the first and second transmission paths have substantially similar signal propagation times.

3. The electrical connector of claim 1, wherein the first transmission path defines a first length and the second transmission path defines a second length that is equal to the first length.

4. The electrical connector of claim 1, wherein the lengths of each of the first, second, third, and fourth contacts are proportional.

5. The electrical connector of claim 1, wherein the first, second, third and fourth contacts are substantially parallel to one another.

6. The electrical connector of claim 1, wherein the fifth and sixth contacts are substantially perpendicular to at least one of the first, second, third and fourth contacts.

7. The electrical connector of claim 1, wherein the fifth and sixth contacts form an arc.

8. The electrical connector of claim 1, wherein the first and second contacts electrically connect to a first device, and wherein the third and fourth contacts electrically connect to a second device.

9. The electrical connector of claim 8, wherein the first and second contacts are substantially perpendicular to the first device, and wherein the third and fourth contacts are substantially perpendicular to the second device.

10. The electrical connector of claim 8, wherein the fifth and sixth contacts are substantially parallel to the first and second devices.

11. The electrical connector of claim 8, wherein the devices are printed wiring boards.

12. The electrical connector of claim 8, wherein the first device is substantially co-planar with the second device.

13. The electrical connector of claim 1, further comprising:

a seventh contact received in the contact base, wherein the seventh contact extends from the contact base in the second direction, wherein the seventh contact is separated from the second contact in the first direction by the first distance;

an eighth contact received in the contact base, wherein the eighth contact extends from the contact base in the second direction, wherein the eighth contact is separated from the fourth contact in the first direction by the first distance, and wherein the seventh contact is substantially parallel to the eighth contact; and a ninth contact electrically connecting the seventh and eighth contacts, wherein the ninth contact makes electrical contact with at least one of the seventh and eighth contacts a fourth distance from the contact base in the second direction, wherein the fourth distance is three times the first distance, and wherein an electrical path through the seventh, eighth, and ninth contacts defines a third transmission path.

14. The electrical connector of claim 13 wherein the first, second and third transmission paths having substantially similar signal propagation times.

15. The electrical connector of claim 13 wherein the first, second and third transmission paths define a first length, a second length and a third length, respectively, and wherein the first, second and third lengths are the same.

16. An electrical connector, comprising:

a first transmission path electrically connecting a first device to a second device, wherein the second device is substantially co-planar with the first device, wherein the first transmission path comprises a first contact, a second contact and a third contact each in electrical connection with one another, wherein the first and second contacts each extend in a first direction and define a first portion and a second portion, respectively, of the first transmission path, and wherein the third contact extends in a second direction and defines a third portion of the first transmission path; and a second transmission path electrically connecting the first device to the second device, wherein the second transmission path comprises a fourth contact, a fifth contact and a sixth contact each in electrical connection with one another, wherein the fourth and fifth contacts each extend in the first direction and a define a first portion and a second portion, respectively, of the second transmission path, and wherein the sixth contact extends in the second direction and defines a third portion of the second transmission path, wherein the fourth and fifth contacts are located between the first and the second contacts, wherein the first, second and third portions of the first transmission path together define a first distance;

wherein the first, second and third portions of the second transmission path together define a second distance, and wherein the first distance is equal to the second distance.

17. The electrical connector of claim 16, wherein the first transmission path comprises:

the first contact electrically connected to the first device;

the second contact electrically connected to the second device; and the third contact electrically connecting the first and second contacts.

18. The electrical connector of claim 16, wherein the second transmission path comprises:

the fourth contact electrically connected to the first device;

the fifth contact electrically connected to the second device; and the sixth contact electrically connecting the fourth and fifth contacts.

19. The electrical connector of claim 16, further comprising a third transmission path, wherein the third transmission path comprises:

a seventh contact electrically connected to the first device, an eighth contact electrically connected to the second device, and a ninth contact electrically connecting the seventh and eighth contacts.

20. The electrical connector of claim 16, wherein the first and second devices are printed wiring boards.

21. The electrical connector of claim 16, wherein the first and second devices are printed circuit boards.

22. An electrical connector comprising:

a contact base;

a plug housing having a plurality of plug contacts received in the contact base, wherein the plurality of plug contacts define a first row of electrical contacts in a first direction and extend from the contact base in a second direction, wherein each of the plurality of plug contacts is separated from a respective adjacent plug contact by a first distance;

a receptacle housing connected to the plug housing and having a plurality of receptacle contacts received in the contact base, wherein the plurality of receptacle contacts define a second row of electrical contacts in the first direction and extend from the contact base in the second direction, wherein the receptacle contacts are substantially parallel to the plug contacts, and wherein each of the plurality of receptacle contacts is separated from a respective adjacent receptacle contact by the first distance; and a plurality of connecting contacts extending in the second direction at an angle to the plurality of plugs contacts and receptacle contacts, wherein a first connecting contact of the plurality of connecting contacts is the first distance from the contact base and a second connecting contact of the plurality of connecting contacts is a second distance from the contact base, wherein the first distance is equal to the second distance and one-half of the third distance, wherein each connecting contact electrically connects a respective plug contact to a respective receptacle contact to form a transmission path, wherein each transmission path defines a length, and the length of each transmission path is substantially the same.

23. The electrical connector of claim 22, wherein the electrical connector carries at least one of single-end and differential transmission signals.

24. The electrical connector of claim 22, wherein the connector is a back-plane connector.

25. The electrical connector of claim 22, wherein the contact plate comprises a retaining dimple to facilitate securing the contact plate within the plug housing.

26. The electrical connector of claim 22, wherein the plug and receptacle contacts are part of an over-molded wafer.

27. The electrical connector of claim 26, wherein the wafer is part of at least one of the plug and receptacle housings.

28. The electrical connector of claim 22, wherein the plug housing further comprises slots for receiving a wall of the receptacle housing.

29. The electrical connector of claim 22, wherein the plug contacts and receptacle contacts protrude through and are supported by, respectively, the contact base, and wherein the plug contacts and receptacle contacts electrically connect with, respectively, a first device and a second device.

30. The electrical connector of claim 29, wherein the first and second devices are printed wiring boards.

31. The electrical connector of claim 22, wherein the connecting contacts are located on a contact plate, wherein the contact plate is secured in the plug housing, and wherein the contact plate is slidably disposed toward the receptacle housing.

32. The electrical connector of claim 31, wherein the contact base further comprises:

a plug contact base for receiving the plurality of plug contacts, wherein the plug contact base defines at least one holding slot that facilitates holding the contact plate in position in the plug housing; and a receptacle contact base for receiving the plurality of receptacle contacts, wherein the receptacle contact base defines at least one guiding slot, wherein the at least one guiding slot guides the contact plate as the receptacle housing is connected to the plug housing.

33. The electrical connector of claim 31, wherein the contact plate is a printed wiring board.

34. The electrical connector of claim 31, wherein the contact plate comprises:

a metal core;

a plurality of grooves in the metal core;

a layer of dielectric material within each of the plurality of grooves; and a connecting contact on the dielectric layer within each of the plurality of grooves.

35. The electrical connector of claim 34, wherein the contact plate further comprises one or more ground contacts in contact with the metal core.

36. The electrical connector of claim 31, wherein the contact plate comprises:

a metal core;

a polymer isolator layer adjacent to each side of the metal core;

a plurality of grooves in the polymer isolator layer;

a connecting contact within each of the plurality of grooves, wherein the polymer isolator layer is metalized around the connecting contacts.

37. The electrical connector of claim 36, wherein the contact plate further comprises one or more ground contacts in contact with the metal core.

38. An electrical connector, comprising:

a contact base defining a first plane;

a first electrical contact and a second electrical contact each received in the contact base, wherein the first and second electrical contacts define a row of electrical contacts in a first direction and extend from the contact base in a second direction, and wherein the first and second contacts are separated from one another in the first direction by a first distance; and a contact plate defining a second plane that is at an angle with the first plane, wherein the contact plate comprises a third electrical contact and a fourth electrical contact each extending in the first direction, wherein the third and fourth electrical contacts are electrically connected to the first and second contacts, respectively, wherein the third and fourth electrical contacts are a second distance and a third distance, respectively, from the contact base in the second direction, wherein the first distance is equal to the second distance, and wherein the third distance is two times the second distance.

39. The electrical connector of claim 38, wherein the first and second directions are substantially perpendicular to one another.

40. The electrical connector of claim 38, wherein the first and second planes are substantially perpendicular to one another.

41. The electrical connector of claim 38, further comprising a fifth electrical contact received in the contact base, wherein the first, second and fifth electrical contacts further define the row of electrical contacts, wherein the fifth electrical contact extends from the contact base in the second direction, and wherein the fifth electrical contact is separated from the second electrical contact in the first direction by the first distance.

42. The electrical connector of claim 41, wherein the contact plate further comprises a sixth electrical contact extending in the first direction, wherein the sixth electrical contact is electrically connected to the fifth electrical contact, wherein the sixth electrical contact is a fourth distance from the contact base in the second direction, and wherein the fourth distance is three times the second distance.

43. The electrical connector of claim 38, further comprising a connector housing for receiving at least a portion of the contact base and at least a portion of the contact plate.

44. The electrical connector of claim 43, wherein the contact plate is slidably disposed within the connector housing.

45. An electrical connector comprising:

a plug housing having a plurality of plug contacts;

a receptacle housing connected to the plug housing having a plurality of receptacle contacts, wherein the receptacle contacts are substantially parallel to the plug contacts; and a plurality of connecting contacts, wherein each connecting contact electrically connects a plug contact to a receptacle contact to form a transmission path, wherein each transmission path has a substantially similar signal propagation time as each of the other transmission paths, wherein a first length of a first connecting contact of the plurality of connecting contacts extends from a respective plug to a respective receptacle contact, wherein a second length of a second connecting contact of the plurality of connecting contacts extends from a respective plug to a respective receptacle contact, wherein the first length is different from the second length, wherein the connecting contacts are located on a contact plate, the contact plate comprising:

a metal core;

a plurality of grooves in the metal core;

a layer of dielectric material within each of the plurality of grooves; and a connecting contact on the dielectric layer within each of the plurality of grooves, wherein the contact plate is secured in the plug housing, and wherein the contact plate is slidably disposed toward the receptacle housing.

46. The electrical connector of claim 45, wherein the contact plate further comprises one or more ground contacts in contact with the metal core.

47. An electrical connector comprising:

a plug housing having a plurality of plug contacts;

a receptacle housing connected to the plug housing having a plurality of receptacle contacts, wherein the receptacle contacts are substantially parallel to the plug contacts; and a plurality of connecting contacts, wherein each connecting contact electrically connects a plug contact to a receptacle contact to form a transmission path, wherein each transmission path has a substantially similar signal propagation time as each of the other transmission paths, wherein a first length of a first connecting contact of the plurality of connecting contacts extends from a respective plug to a respective receptacle contact, wherein a second length of a second connecting contact of the plurality of connecting contacts extends from a respective plug to a respective receptacle contact, wherein the first length is different from the second length, wherein the connecting contacts are located on a contact plate, the contact plate comprising:

a metal core;

a polymer isolator layer adjacent to each side of the metal core;

a plurality of grooves in the polymer isolator layer; and a connecting contact within each of the plurality of grooves, wherein the polymer isolator layer is metalized around the connecting contacts, wherein the contact plate is secured in the plug housing, and wherein the contact plate is slidably disposed toward the receptacle housing.

48. The electrical connector of claim 47, wherein the contact plate further comprises one or more ground contacts in contact with the metal core.

* * * * *